US011421687B2

(12) United States Patent
Tsai et al.

(10) Patent No.: US 11,421,687 B2
(45) Date of Patent: Aug. 23, 2022

(54) WATER LUBRICATION TWIN-SCREW AIR COMPRESSING SYSTEM

(71) Applicant: FU SHENG INDUSTRIAL CO.,LTD., Taipei (TW)

(72) Inventors: Min-Jen Tsai, Kinmen County (TW); Chih-Lung Tseng, Taipei (TW); Feng-Yung Lin, New Taipei (TW)

(73) Assignee: FU SHENG INDUSTRIAL CO., LTD, Taipei (TW)

( * ) Notice: Subject to any disclaimer, the term of this patent is extended or adjusted under 35 U.S.C. 154(b) by 163 days.

(21) Appl. No.: 16/734,288

(22) Filed: Jan. 3, 2020

(65) Prior Publication Data

US 2020/0141409 A1 May 7, 2020

Related U.S. Application Data

(63) Continuation of application No. 15/267,107, filed on Sep. 15, 2016, now abandoned.

(30) Foreign Application Priority Data

Sep. 23, 2015 (TW) ..... 104215352

(51) Int. Cl.
*F04C 18/16* (2006.01)
*F04C 29/00* (2006.01)

(52) U.S. Cl.
CPC ..... *F04C 18/16* (2013.01); *F04C 29/0007* (2013.01); *F04C 2280/04* (2013.01)

(58) Field of Classification Search
CPC ... F04C 18/16; F04C 29/0007; F04C 2280/04
See application file for complete search history.

(56) References Cited

U.S. PATENT DOCUMENTS 5,222,874 A * 6/1993 Unnewehr ..... F04C 29/042 417/372
5,626,470 A * 5/1997 Gerhardt ..... F04C 29/0021 184/6
5,947,711 A * 9/1999 Myers ..... B01D 45/08 418/85
6,102,683 A * 8/2000 Kirsten ..... F04C 29/0007 418/85
6,287,084 B1 * 9/2001 Kirsten ..... F04C 29/04 417/228

(Continued)

*Primary Examiner* — Connor J Tremarche
(74) *Attorney, Agent, or Firm* — Li & Cai Intellectual Property (USA) Office

(57) ABSTRACT

A water lubrication screw type air compressor includes a compressor, an air-loop system and a water-loop system. The water-loop system includes a water supply device, a first water-loop unit and a second water-loop unit. The water supply device includes a first water-treatment device to modify the water quality and provide purified water. The first water-loop unit includes a second water-treatment device to modify water quality and reduce the corrosion of metal components. The second water-loop unit includes a water filter to remove the impurities in water and maintain the purity of cycling water. Therefore, the water-loop system in the present disclosure includes multiple water-treatment devices and filters to maintain the water quality. The purified water ensures better cooling, lubrication and air proofing when injected into the compressor.

14 Claims, 3 Drawing Sheets

(56) References Cited

U.S. PATENT DOCUMENTS

| | | | | |
|---|---|---|---|---|
| 6,409,489 | B1 * | 6/2002 | Bodart | F04C 29/0007 418/84 |
| 2006/0213210 | A1 * | 9/2006 | Tomlinson | F24H 4/04 62/238.6 |
| 2009/0191082 | A1 * | 7/2009 | Yoshimura | F04C 29/021 418/83 |
| 2011/0209446 | A1 * | 9/2011 | Kayat | B01D 45/08 55/322 |
| 2013/0015669 | A1 * | 1/2013 | Favilli | F03B 13/10 290/1 R |
| 2014/0308148 | A1 * | 10/2014 | Takeda | F04C 29/021 418/84 |
| 2016/0069057 | A1 * | 3/2016 | Okubo | E03D 5/10 4/434 |

* cited by examiner

WATER LUBRICATION TWIN-SCREW AIR COMPRESSING SYSTEM

CROSS-REFERENCE TO RELATED APPLICATIONS

This application is a continuation application of U.S. application Ser. No. 15/267,107, filed on Sep. 15, 2016, and entitled "WATER LUBRICATION TWIN-SCREW AIR COMPRESSOR", the entire contents of which are hereby incorporated by reference.

BACKGROUND OF THE INVENTION

1. Field of the Invention

The present disclosure relates to a compressor; in particular, to a water lubrication twin-screw air compressing system.

2. Description of Related Art

Conventional air compressors can be categorized into oil lubrication type compressors and oil-free type compressors based on the mechanism of lubrication. The oil in the oil lubrication type compressor achieves lubrication and airproofing by forming an oil membrane over the screw rotors and the compression chamber, thus avoiding the wear of metal surfaces and the leaking of compressed air. Furthermore, the oil cools down the compression heat during the compression process, thus decreasing the compression temperature and increasing the compression efficiency.

During the early stage of compression, the oil attaches to the screw rotors and the inner wall of the compression chamber as the air enters the airproofed compression chamber. However, after a period of compression, the oil no longer cools the compression heat. Therefore, the compression temperature increases rapidly and the compression efficiency decreases. In addition to oil lubrication, there is a water lubrication screw-type compressor that employs an oil-free design in the compression chamber. The water lubrication screw-type compressor requires no oil during the compression and generates no vaporized oil to contaminate the injected air. However, the water quality in the water-loop of the water lubrication screw-type compressor degrades after a period of cycling, thus decreasing the effect of cooling and air proofing.

In this regard, the inventor developed a new design to address the aforementioned limitations of the conventional water lubrication screw-type compressor.

SUMMARY OF THE INVENTION

The present disclosure provides a water lubrication screw type air compressor that can modify and purify the water in the water-loop, thus reducing the corrosion of metal components and improving the effect of cooling, lubrication, and air proofing.

One of the embodiments of the instant disclosure provides a water lubrication twin-screw air compressing system, which includes a compressor, an air-loop system, and a water-loop system. The compressor is a water lubrication air compressor having a pair of screw rotors disposed therein. The pair of screw rotors are complementary male rotor and female rotor to compress air. The compressor includes a compressor housing formed with a compression chamber therein, an axial sealing device disposed inside the compression chamber, a first water-injection port, and a second water-injection port. The first water-injection port connects to the axial sealing device, and the second water-injection port connects to the compression chamber. The air-loop system is fluidically connected to the compressor, and includes an air filter, an air valve fluidically connected to the air filter, a first check valve fluidically connected to the air valve and the compressor, a moisture separator, and a first control valve. The first check valve prevents air from flowing backward from the compressor to the air valve. The moisture separator separates air from moisture, and fluidically connects to the air valve and the compressor to receive an air-water mixture from the compressor. The first control valve is fluidically connected between the air valve and the moisture separator. The air separated by the moisture separator is capable of being transported to the air valve to adjust an air injection volume of the air valve by controlling the first control valve. The water-loop system includes a water supply device, a first water-loop unit and a second water-loop unit. The water supply device is fluidically connected to the compressor and an external water source, and includes a first water-treatment device. The first water-loop unit is fluidically connected to the moisture separator and the first water-injection port of the compressor, and includes a second water-treatment device. The second water-loop unit is fluidically connected to the moisture separator and the second water-injection port of the compressor, and includes a water filter.

The present disclosure has at least the following advantages:

The water lubrication screw type air compressor in the present disclosure employs a water supply device that includes a water filter to supply water, thus the water supply device can modify the water quality and provide purified water. The first water-loop unit includes a second water-treatment device to modify water quality, thus reduces the corrosion of metal components. The second water-loop unit includes a water filter to remove the impurities in water, thus maintaining the purity of the cycling water. Therefore, the water-loop system in the present disclosure includes multiple water treatment/filter devices to maintain the water quality. The purified water ensures better cooling, lubrication, and air proofing when injected into the compressor.

In order to further the understanding regarding the present disclosure, the following embodiments are provided along with illustrations to facilitate the disclosure of the present disclosure. The invention may be embodied in many different forms and should not be construed as limited to the embodiments set forth herein; rather, these embodiments are provided so that this disclosure will satisfy applicable legal requirements.

BRIEF DESCRIPTION OF THE DRAWINGS

Corresponding reference numerals indicate corresponding parts throughout the several views of the drawings.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
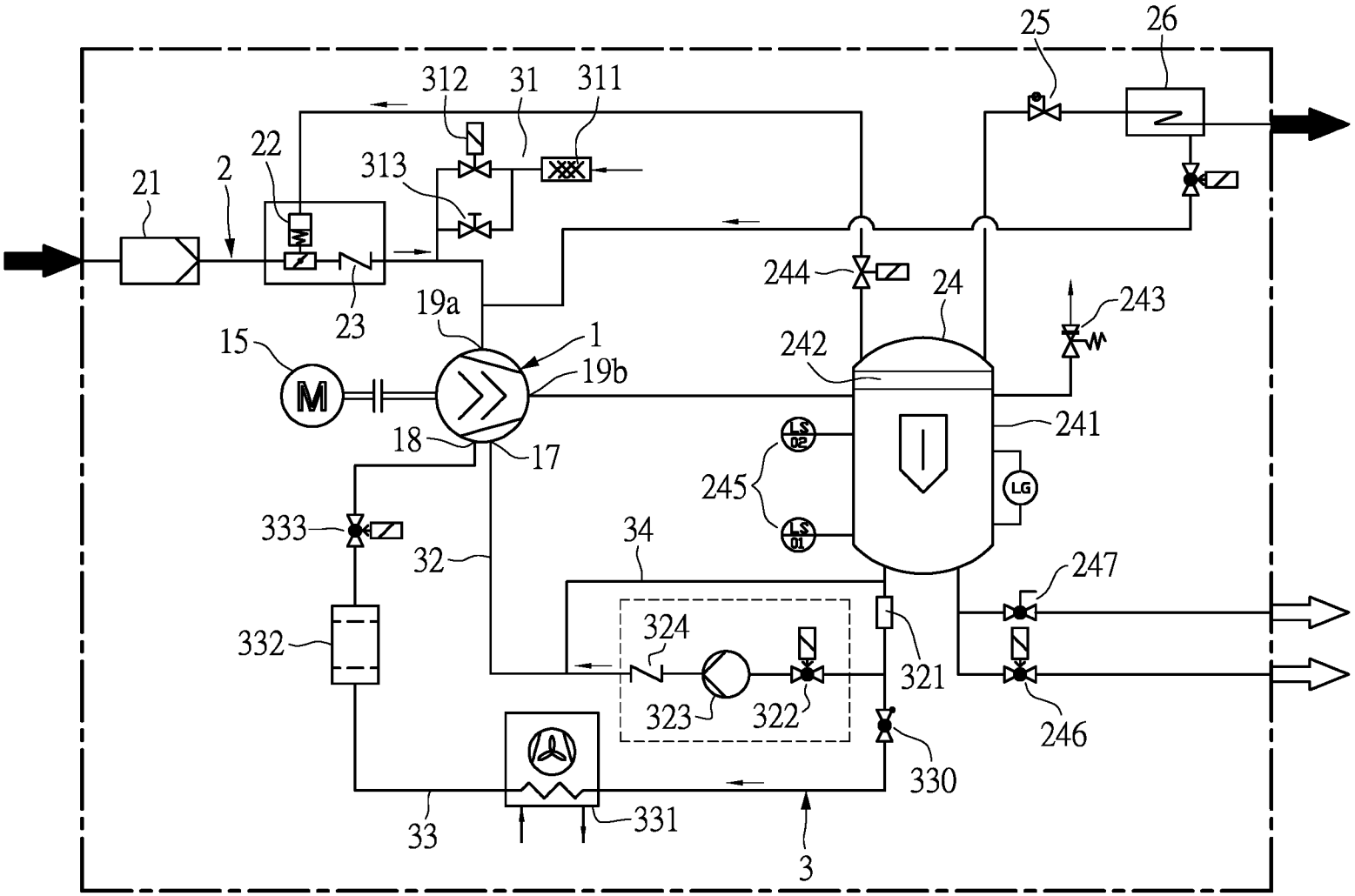
FIG. 1 shows a schematic diagram of a water lubrication screw type air compressor according to the present disclosure.

FIG. 1 shows a schematic diagram of a water lubrication screw type air compressor according to the present disclosure, which includes a compressor 1, an air-loop system 2 and a water-loop system 3.

Figure 2:
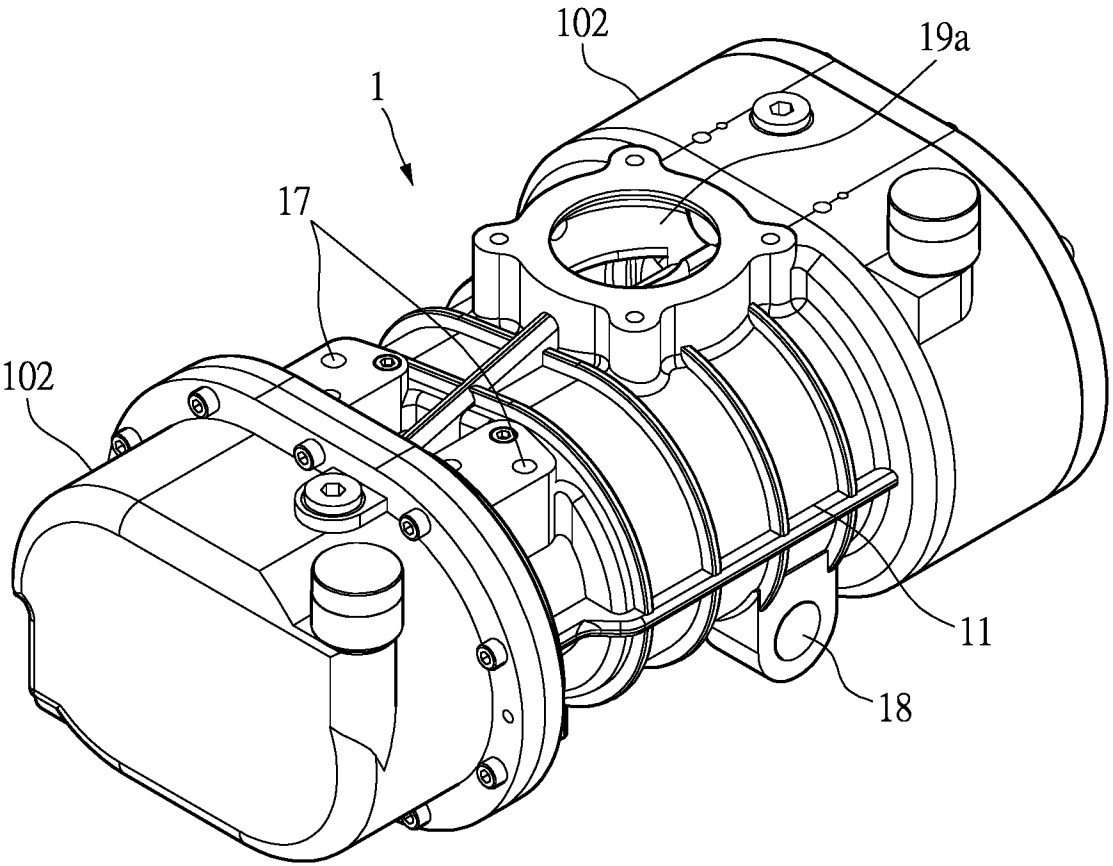
FIG. 2 is a three-dimensional view of a water lubrication screw type air compressor according to the present disclosure.
Figure 3:
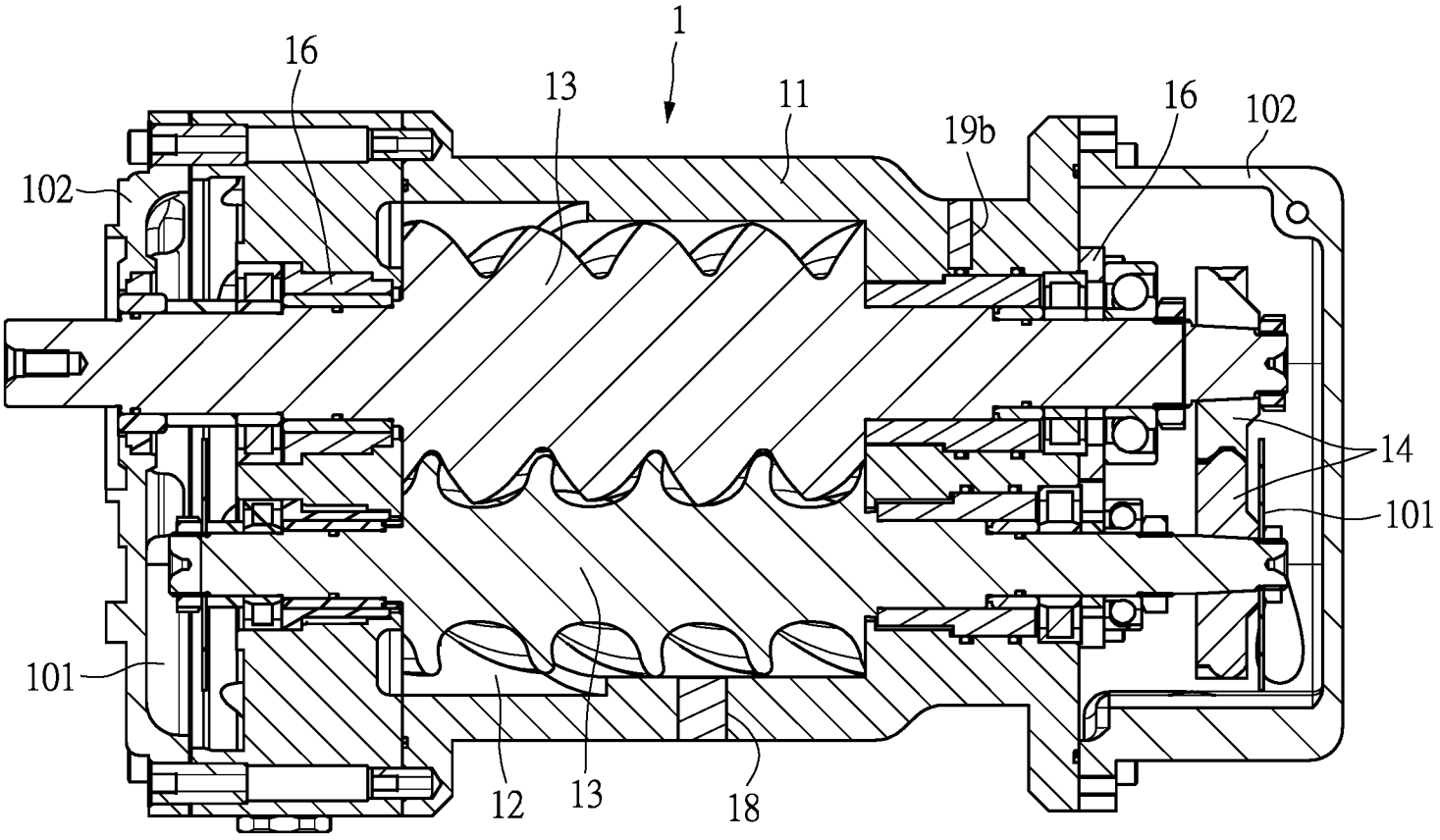
FIG. 3 is a cross-sectional view through a center of a water lubrication screw type air compressor according to the present disclosure.

FIG. 2 and FIG. 3 are a three-dimensional view and a cross-sectional view of a water lubrication screw type air compressor according to the present disclosure. The compressor 1 is a water lubrication screw type air compressor that projects the compressed air-water mixture by compressing the injected air and water to a specific volume. The compressor 1 includes a compressor housing 11 that houses a compression chamber 12 and a pair of screw rotors 13. The pair of screw rotors 13 are complementary male rotor and female rotor to compress air. The pair of screw rotors 13 connects to a synchronous gear 14 actuated by a driver 15. The driver 15 can be, but is not limited to, an electric motor, pneumatic motor, hydraulic motor or turbine.

The bilateral ends of the pair of screw rotors 13 have an axial sealing 16 to prevent a vaporized oil from contaminating the injected air. The compressor 1 includes a first water-injection port 17 and a second water-injection port 18. The first water-injection port 17 connects to the axial sealing 16, and the second water-injection port 18 connects to the compression chamber 12. The first water-injection port 17 and second water-injection port 18 inject water to the axial sealing 16 and compression chamber 12 for cooling and air proofing. For example, injecting water into the space between the compression chamber 12 and the pair of screw rotors 13 can not only cool the air during compression, but also airproof the compression process by forming a liquid membrane onto the inner wall of the compassion chamber 12 and the pair of screw rotors 13. Therefore, the airproof and compression efficiency of the compressor 1 are improved.

In the current embodiment, the compressor 1 further includes two oil pans 101 placed at the bilateral ends of one of the pair of screw rotors 13. The two oil pans 101 remove the lubrication oil stored in the oil tank 102 from the oil lubricated bearings and gears. The compressor 1 also includes an inlet end 19*a* and an outlet end 19*b*, and both connect to the air-loop system 2.

The air-loop system 2 includes an air filter 21, an air valve 22 and a first check valve 23. The air filter 21 connects to the air valve 22, the air valve 22 connects to the first check valve 23, and the first check valve 23 connects to the inlet end 19*a* of the compressor 1. That is, the air filter 21, the air valve 22, the first check valve 23 and the compressor 1 are fluidly connected one by one so the air-loop system 2 can inject air into the compressor 1 via the inlet end 19*a*. The air valve 22 can be, but is not limited to, a piston valve or butterfly valve to adjust the volume of air injection. The air valve 22 is set upstream from the compressor 1, and thus can adjust the volume of air injected into the compressor 1 according to an air source. The first check valve 23 prevents the air from flowing backward during power off. Please note the present disclosure does not intend to limit the structure of the air filter 21, the air valve 22 and the first check valve 23.

The air-loop system 2 includes a moisture separator 24, and can further comprise a pressure-maintaining valve 25 and a dryer 26. The outlet end 19*b* of the compressor 1 connects to the moisture separator 24, the moisture separator connects to the pressure-maintaining valve 25, the pressure-maintaining valve 25 connects to the dryer 26. That is, the compressor 1, the moisture separator 24, the pressure-maintaining valve 25 and the dryer 26 are fluidly connected one by one so the air-loop system 2 can receive the air-water mixture from the compressor 1. The pressure-maintaining valve 25 stabilizes the pressure of air from the air-loop system 2. The dryer 26 is a refrigeration dryer placed at the exit of the air-loop system 2. The dryer 26 cools and dries the air, and then outputs the cooled and dried air.

The moisture separator 24 is placed downstream of the compressor 1, which conducts an air-water separation process on the air-water mixture from the compressor 1. The current invention does not intend to limit the type and structure of the moisture separator 24. In the current embodiment, the moisture separator 24 includes a cyclone separator 241 and a stainless steel water eliminator 242. The air-water mixture from the compressor 1 undergoes a first air-water separation process by the cyclone separator 241, and then undergoes a second air-water separation process by the stainless steel water eliminator 242. The moisture separator 24 can further include a safety valve 243. The air from the moisture separator 24 passes through the pressure-maintaining valve 25 and dryer 26 before being output. The moisture separator 24 can link to the air valve 22 via the first control valve 244, for adjusting the clearance of the air valve 22.

The moisture separator 24 can further comprise a level detector 245, an automatic drain valve 246 and a manual drain valve 247. The level detector 245 detects the water level in the moisture separator 24. When the water level is too high, the water is drained by the automatic drain valve 246 or manual drain valve 247; when the water level is too low, the water is replenished.

The water-loop system 3 includes a water supply device 31, a first water-loop unit 32 and a second water-loop unit 33. The water supply device 31 connects an external water source and the inlet end 19*a* of the compressor 1. The water supply device 31 includes a first water-treatment device 311, and can further comprise an automatic water supply valve 312 and a manual water supply valve 313. The external water source connects to the first water-treatment device 311, the first water-treatment device 311 connects to the automatic water supply valve 312 and the manual water supply valve 313, and the automatic water supply valve 312 and the manual water supply valve 313 connect to the inlet end 19*a* of the compressor 1. That is, the external water source, the first water-treatment device 311, and the automatic/manual water supply valve 312/313 are fluidly connected one by one so the water supply device 31 can supply water to the compressor 1. The first water-treatment device 311 can be, but is not limited to, a reverse osmosis device or water softener to modify and purify the supplied water. In addition, the dryer 26 can connect to the inlet end 19*a* of the compressor 1 to recycle the condensate water from the dryer 26, thus saving the water usage.

The first water-loop unit 32 connects the moisture separator 24 and the first water-injection port 17. The first water-loop unit 32 includes a second water-treatment device 321, and can further comprise a second control valve 322, an assistive pump 323 and a second check valve 324. The moisture separator 24 connects to the second water-treatment device 321, the second water-treatment device 321 connects to the second control valve 322, the second control valve 322 connects to the assistive pump 323, the assistive pump 323 connects to the second check valve 324, the second check valve 324 connects the first water-injection port 17 of the compressor 1. That is, the moisture separator 24, the second water-treatment device 321, the second control valve 322, the assistive pump 323, the second check valve 324 and compressor 1 are fluidly connected one by one so the first water-loop unit 32 of the water-loop system 3 connects the moisture separator 24 and the compressor 1. The second water-treatment device 321 can be a sacrificial anode to adjust the concentration of metal ions in the water, thus reducing the corrosion of metal components. Please note the present disclosure does not intend to limit the type and structure of the second water-treatment device 321. The assistive pump 323 auxiliarily pressurizes the water to the first water-injection port 17 of the compressor 1. Therefore, the assistive pump 323 can pressurize the water pumping into the first water-injection port 17 of the compressor 1. That is, the assistive pump 323 operates for few seconds right at initiation phase when the compressor 1 is unpressured, thus opening the second control valve 322 and pumping a portion of water into the compressor 1.

The second water-loop unit 33 connects the moisture separator 24 and the second water-injection port 18 of the compressor 1. The second water-loop unit 33 can comprise a third check valve 330, a cooling device 331, a water filter 332 and a third control valve 333. The second water-treatment device 321 of the first water-loop unit 32 connects to the third check valve 330, the third check valve 330 connects to the cooling device 331, the cooling device 331 connects to the water filter 332, the water filter 332 connects to the third control valve 333, the third valve 333 connects to the second water-injection port 18 of the compressor 1. That is, the moisture separator 24, the second water-treatment device 321, the third check valve 330, the cooling device 331, the water filter 332, the third control valve 333 and the compressor 1 are fluidly connected one by one so the second water-loop unit 33 of the water-loop system 3 connects the moisture separator 24 and the compressor 1. The cooling device 331 can be an air-cooled or a water-cooled heat exchanger to cool down the lubrication water with elevated temperature. After cooling, the water with lower temperature is filtered by the water filter 332 to remove the impurities and improve water quality. The filtered water is injected into the compression chamber 12 of the compressor 1.

The water-loop system 3 can further comprise a third water-loop unit 34. The third water-loop unit 34 connects the moisture separator 24 and the first water-injection port 17. That is, the third water-loop unit 34 connects to the moisture separator 24 by one side, and connects to the first water-injection port 17 of the compressor 1 by the other side. Therefore, the third water-loop unit 34 can inject water to the axial sealing 16 of the compressor 1. The water from the first water-injection port 17 and the second water-injection port 18 cools, lubricates, and airproofs the pair of the screw rotors 13 in the compressor housing 11 as well as the axial sealing 16, thus a complete water cycle is established.

The present disclosure, specifically a water lubrication screw type air compressor, includes the compressor 1, the air-loop system 2 and the water-loop system 3. The water-loop system 3 includes the water supply device 31, the first water-loop unit 32 and the second water-loop unit 33. The water supply device 31 includes the first water-treatment device 311. The first water-loop unit 32 connects the moisture separator 24 and the first water-injection port 17 of the compressor 1. The first water-loop unit 32 further includes the second water-treatment device 321. The second water-loop unit 33 connects to the moisture separator 24 and the second water-injection port 18 of the compressor 1. The second water-loop unit 33 further includes the water filter 332.

The present disclosure gets water supply from the water supply device 31. The water supply device 31 includes the first water-treatment device 311 to modify the quality of water and provide purified water. In addition, the first water-loop unit 32 includes a second water-treatment device 321 to modify the quality of water, thus reduces the corrosion of metal components. Furthermore, the second water-loop unit 33 includes a water filter 332 to remove the impurities in the cycling water. Therefore, the present disclosure includes multiple water treatment and filter devices to modify and purify the water injected into the compressor 1. In this regard, the present disclosure can attain a better effect of cooling, lubrication and airproofing.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A water lubrication twin-screw air compressing system comprising:

a compressor, being a water lubrication air compressor having a pair of screw rotors disposed therein, the pair of screw rotors being complementary male rotor and female rotor to compress air, wherein the compressor includes a compressor housing formed with a compression chamber therein, an axial sealing device disposed in the compression chamber, a first water-injection port, and a second water-injection port; wherein the first water-injection port connects to the axial sealing device, and the second water-injection port connects to the compression chamber;

an air-loop system, fluidically connected to the compressor, wherein the air-loop system includes:

an air filter;

an air valve fluidically connected to the air filter;

a first check valve fluidically connected to the air valve and the compressor, so as to prevent air from flowing backward from the compressor to the air valve;

a moisture separator for separating air from moisture, fluidically connected to the air valve and the compressor to receive an air-water mixture from the compressor; and a first control valve fluidically connected between the air valve and the moisture separator, wherein the air separated by the moisture separator is capable of being transported to the air valve to adjust an air injection volume of the air valve by controlling the first control valve; and a water-loop system including:

a water supply device, fluidically connected to the compressor and an external water source, and including a first water-treatment device;

a first water-loop unit, fluidically connected to the moisture separator and the first water-injection port of the compressor and including a second water-treatment device, so as to modify a quality of water and to reduce corrosion of a plurality of metal components; and a second water-loop unit, fluidically connected to the moisture separator and the second water-injection port of the compressor and including a water filter, so as to remove impurities in the cycling water, wherein the second water-loop unit is isolated from the first water-loop unit, and wherein the water supply device is isolated from the first water-loop unit.

2. The water lubrication twin-screw air compressing system according to claim 1, wherein the pair of screw rotors are connected to a synchronous gear actuated by a driver, and the axial sealing device is disposed at bilateral ends of the pair of screw rotors.

3. The water lubrication twin-screw air compressing system according to claim 2, wherein the compressor further comprises two oil pans disposed at bilateral ends of one of the pair of screw rotors.

4. The water lubrication twin-screw air compressing system according to claim 2, wherein the driver is an electric motor, pneumatic motor, hydraulic motor or turbine.

5. The water lubrication twin-screw air compressing system according to claim 1, wherein the air-loop system further comprises a pressure-maintaining valve and a dryer, the moisture separator is fluidically connected to the pressure-maintaining valve, and the pressure-maintaining valve is fluidically connected to the dryer.

6. The water lubrication twin-screw air compressing system according to claim 5, wherein the dryer is a refrigeration dryer, and the dryer fluidically connects to the compressor to drain condensate water to the compressor.

7. The water lubrication twin-screw air compressing system according to claim 1, wherein the moisture separator includes a cyclone separator and a stainless steel water eliminator, the cyclone separator conducting a first air-water separation process and the stainless steel water eliminator conducting a second air-water separation process on an air-water mixture from the compressor.

8. The water lubrication twin-screw air compressing system according to claim 1, wherein the moisture separator includes a level detector, an automatic drain valve and a manual drain valve, the level detector detects a water level in the moisture separator, and the water is able to be drained by the automatic drain valve or the manual drain valve.

9. The water lubrication twin-screw air compressing system according to claim 1, wherein the water supply device further comprises an automatic water supply valve and a manual water supply valve, the first water-treatment device is fluidically connected to the automatic water supply valve and the manual water supply valve, and the automatic water supply valve and the manual water supply valve are fluidically connected to the compressor.

10. The water lubrication twin-screw air compressing system according to claim 1, wherein the first water-treatment device is a reverse osmosis device or water softener.

11. The water lubrication twin-screw air compressing system according to claim 1, wherein the second water-treatment device is a sacrificial anode.

12. The water lubrication twin-screw air compressing system according to claim 1, wherein the first water-loop unit includes a second control valve, an assistive pump and a second check valve, the moisture separator is fluidically connected to the second water-treatment device, the second water-treatment device is fluidically connected to the second control valve, the second control valve is fluidically connected to the assistive pump, the assistive pump is connected to the second check valve, and the second check valve is fluidically connected to the first water-injection port of the compressor.

13. The water lubrication twin-screw air compressing system according to claim 1, wherein the second water-loop unit comprises a third check valve, a cooling device and a third control valve, the second water-treatment device of the first water-loop unit is fluidically connected to the third check valve, the third check valve is fluidically connected to the cooling device, the cooling device is fluidically connected to the water filter, the water filter is fluidically connected to the third control valve, and the third control valve is fluidically connected to the second water-injection port of the compressor.

14. The water lubrication twin-screw air compressing system according to claim 1, wherein the water-loop system further comprises a third water-loop unit that fluidically connects the moisture separator and the first water-injection port.

* * * * *